United States Patent [19]

John

[11] 4,131,263

[45] Dec. 26, 1978

[54] FIXED LIMIT LIFTING JACK

[75] Inventor: Julius F. John, Redondo Beach, Calif.

[73] Assignee: Norco Industries, Inc., Gardena, Calif.

[21] Appl. No.: 843,595

[22] Filed: Oct. 19, 1977

[51] Int. Cl.[2] ..... B66F 5/04

[52] U.S. Cl. ..... 254/8 B

[58] Field of Search ..... 254/2 B, 8 B, 93 R, 254/124

[56] References Cited

U.S. PATENT DOCUMENTS

| | | | |
|---|---|---|---|
| 2,219,903 | 10/1940 | Pfauser | 254/2 B |
| 2,702,988 | 3/1955 | Rhoads et al. | 254/2 B |
| 4,018,421 | 4/1977 | Tallman | 254/8 B |

*Primary Examiner*—Robert C. Watson

[57] ABSTRACT

A lifting jack with its elevating linkage has an elongated base supported on wheels and a hydraulic ram horizontally disposed in the base. A block which is a structural part of the base incorporates a hydraulic reservoir, a pump, valving, and a lift-lower control. A single handle serves both to actuate the pump and manipulate the lift-lower control. An overload release valve which can be factory-adjusted to limit the load which the jack can lift is interiorly mounted and combined with the lift-lower control to inhibit tampering which could inadvertently overload the jack.

12 Claims, 9 Drawing Figures

FIXED LIMIT LIFTING JACK

This is an improvement on U.S. Pat. No. 4,018,421 for a PORTABLE LIFTING JACK.

Hydraulic lifting jacks, although adapted to a variety of uses, have been widely used under the axle of an automobile for lifting one or both wheels at one end of the automobile off the ground. Equipment of this kind heretofore has more commonly been of a character used in garages and service stations than by the individual car owner. Devices in the past have been large, heavy, and expensive. The general character of such jacks have, however, made them extremely useful and easily manipulatable in the hands of a mechanic when there is need to slide a jack under an automobile beneath an axle which is a considerable distance inward from overhanging portions of the chassis and vehicle body.

Improvements in design and construction have now made it possible to build such lifting jacks more compactly and at lower cost, the result being more widespread use by not only mechanics, but also individual owners of automotive vehicles.

Another condition having appreciable bearing on the use of lifting jacks is the great increase in the variety of automotive vehicles, the weight of which varies widely from that of extremely light subcompact cars to that of relatively heavy pick-up trucks and recreation vehicles.

Lifting jacks for light weight vehicles can naturally be of comparable light weight construction and limited lifting capacity. Quite naturally, the lifting jack of more limited lifting capacity is more easily carried about and stored, as well as being a tool of lower cost.

When there are vehicles of different weights to be handled, the common tendency is to use whatever lifting jack may be handy to get the job done, and a jack may often be used to the limit of its capacity.

So that a lifting jack cannot be overloaded beyond its structural capacity, manufacturers employ an overload release. Such an overload release is virtually a necessity, not only to prevent damage to the jack itself, but also to avoid accidents and bodily harm to a workman who might be beneath a vehicle when the equipment fails.

Overload release devices are customarily set at a safe adjustment at the factory prior to sale. A knowledgeable competent mechanic, however, can readjust the overload and the normal human tendency is to readjust the overload release upwardly when a particular lifting jack will not quite do the job, counting on the safety factor customarily employed by the maker. Then, when a failure occurs, the user tends to blame the maker for a defective design, especially when an injury results.

It is, therefore, among the objects of the invention to provide a new and improved lifting jack of compact character with an overload release such that it can be accurately set by the maker, and not readily reset by the user.

Another object of the invention is to provide a new and improved hydraulic lifting jack of compact character and moderate weight, wherein an overload release is so designed and located that readjustment with other than factory equipment is impractical and difficult.

Still another object of the invention is to provide a new and improved hydraulic lifting jack wherein an overload release device is made part of a lowering mechanism and effectively concealed within the structure so that the overload release cannot be readily tampered with in the absence of partial disassembly of the jack.

With these and other objects in view, the invention consists in the construction, arrangement, and combination of the various parts of the device, whereby the objects contemplated are attained, as hereinafter set forth, pointed out in the appended claims and illustrated in the accompanying drawings:

Figure 1:
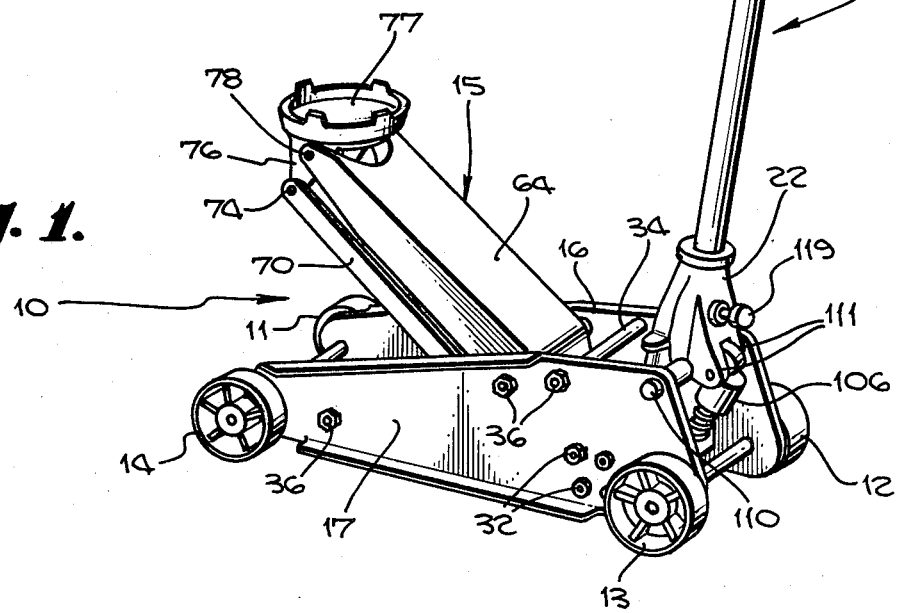
FIG. 1 is a side perspective view of the lifting jack in an elevated position.

In an embodiment of the invention chosen for purpose of illustration, and as generally appears in FIG. 1, there is shown a low-slung jack of the type in which the overload release is useful, consisting of a frame or chassis indicated generally by the reference character 10 and carried by wheels 11, 12, 13 and 14. An elevating linkage 15 is pivotally mounted on the frame for operation between opposite side plates 16 and 17. There is a hydraulic power unit consisting in part of a hydraulic cylinder 20, serving as a power unit, not visible in FIG. 1, but clearly shown in FIGS. 2 through 7, which is mounted between the side plates 16 and 17. The power unit is manipulated by a handle assembly 21 consisting in the main of a yoke 22 pivoted on the side plates 16 and 17, and an extendible shaft 23 serving as a handle.

Figure 2:
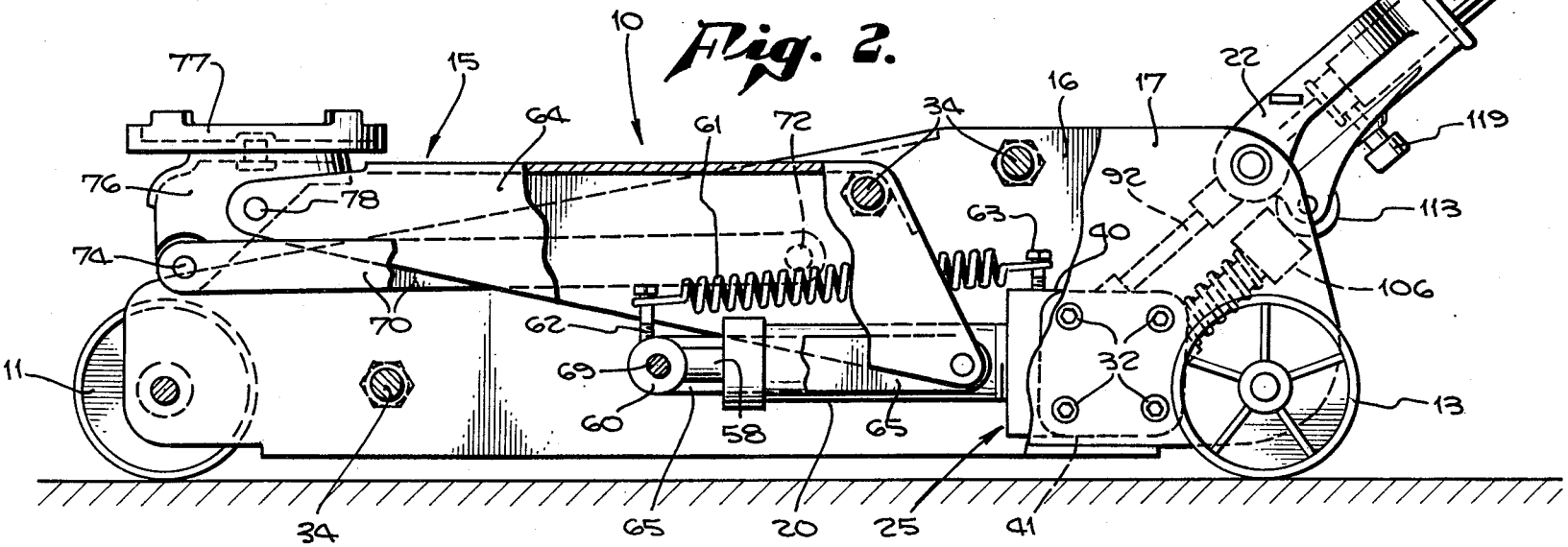
FIG. 2 is a side elevational view partially broken away and showing the jack in lowered position.

Reference is made to FIG. 2 for the location of a multi-purpose block 25 serving as a hydraulic housing and FIGS. 3 through 7 for its internal construction.

The multi-purpose block 25 has opposite flat side walls 26 and 27 which engage respective side plates 16 and 17 of the frame 10 on the respective inside faces. In the chosen embodiment, flat side walls are substantially square in configuration and four bolts 32 extend through the side plate in each instance and into the block adjacent the corners of the respective side wall. In this fashion the block 25 serves as a spacer between the side plates and also as a rigid means of appreciable stability for holding the side plates in assembled relationship adjacent one end of the frame.

Elsewhere spanning the distance between the plates are spacers 34 having threaded outer ends for attachment of nuts 36 over lock washers.

Figure 7:
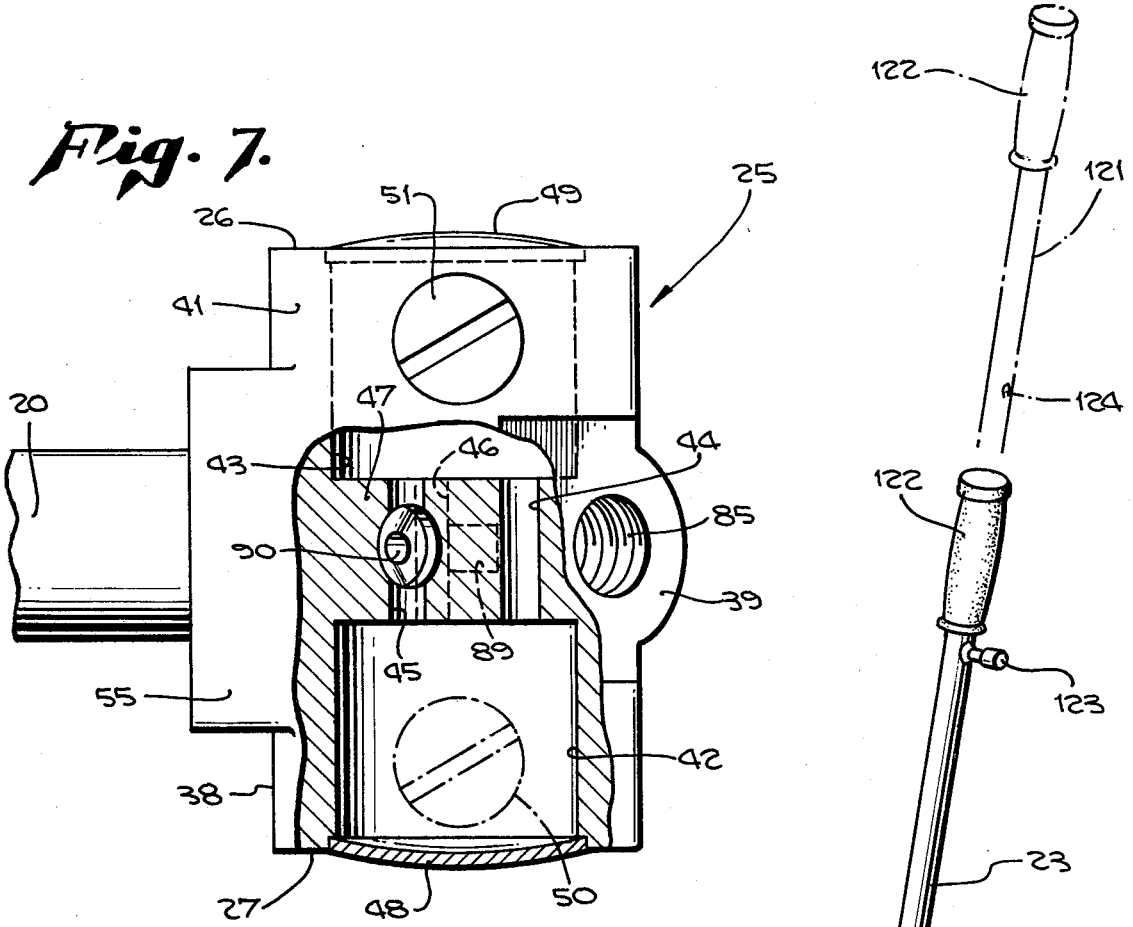
FIG. 7 is a plan view of the hydraulic reservoir block partially broken away.

As shown in FIG. 7, the block 25 has in addition to side walls 26 and 27 a relatively flat inside end wall 38 and a relatively flat outside end surface 39, the inside end wall 38 extending vertically and the outside end surface 39 extending obliquely at a selected inclination commensurate with operation of the operating handle. There is also a relatively flat top wall 40 and a relatively flat bottom wall 41.

Within the multi-purpose block 25, as shown in FIG. 7, there is a reservoir for hydraulic fluid consisting mainly of chambers 42 and 43 interconnected by horizontal passages 44, 45 and 46. The passages extend through a relatively thick partition 47 which has mainly a structural function in addition to serving as a separation between the chambers 42 and 43. Discs 48 and 49 at outer ends of the respective chambers 42 and 43 are shown in FIG. 7. For the chamber 42 there is a removable cap 50, and for the chamber 43 a removable cap 51 which when removed permit filling of the reservoir with hydraulic fluid. These caps are readily accessible from the top of the frame.

Protruding from the inside end wall 38 is a boss 55 provided with a threaded opening 56 in which is mounted the hydraulic cylinder 20. A washer 57 assures a sealed connection. The power unit is provided with a ram 58 on the right end of which is a piston head 59 as viewed in FIGS. 3 through 6. The ram is connected to a trunnion 60, as shown in FIG. 2. A spring 61 is attached at one end to the trunnion 60 by means of a bolt 62 and at the other end is attached to the upper side of the block 25 by means of a bolt 63. The spring is biased so as to return the ram and piston head to initial position when there is no pressure in the cylinder.

The ram acting through the trunnion serves to raise the elevator 15 which is of substantially conventional construction. The elevator consists in part of an elevator arm 64 pivotally carried by the side plates and also connected to one of the spacers 34. Trunnion arms 65 are connected to the elevator arm at the right end as viewed in FIG. 2, by means of pivot pins 67. At the opposite or left-hand ends of the trunnion arms there is a pivot pin 69 comes to both arms which extends laterally from the trunnion 60. The parts have heretofore been termed an elevator linkage.

Control arms 70 are connected at their right-hand ends as viewed in FIG. 2 to the respective side plates 16 and 17 by means of pivot pins 72. At their left-hand ends the control arms are attached by means of pivot pins 74 to a bracket 76, the bracket in turn supporting a lifting platform 77. The left-hand end of the elevator arm 64 is also attached to the same bracket 76 by means of pivot pins 78. As appears from the foregoing description when the ram 58 is extended, namely moving from right to left as viewed in FIG. 2, the elevator is raised by lever action, namely the trunnion arm 65 pulling on the pivot pins 67 and the resulting force tilting the elevator arm 64 angularly upward. Meanwhile, the control arms 70 force the bracket 76 and lifting platform 77 to remain horizontal as the lifting platform engages the axle or other load.

Figure 5:
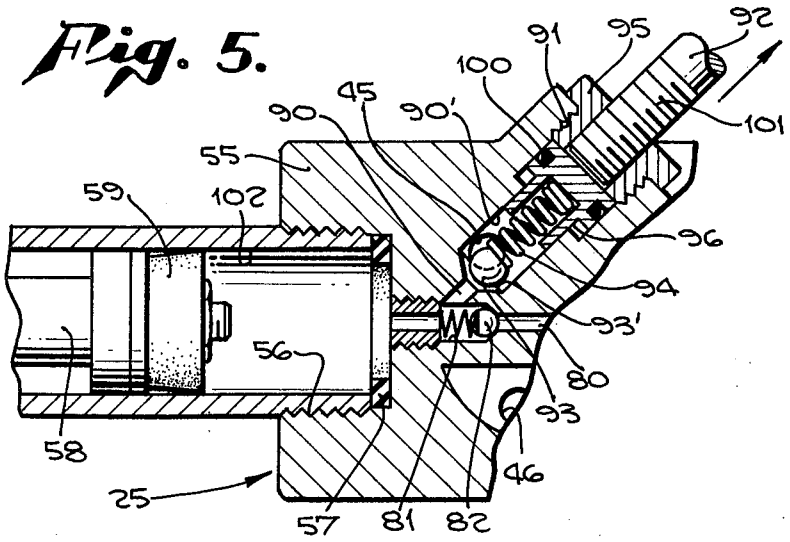
FIG. 5 is a fragmentary longitudinal sectional view similar to FIGS. 3 and 4, but showing the parts in position for a lowering operation.
Figure 4:
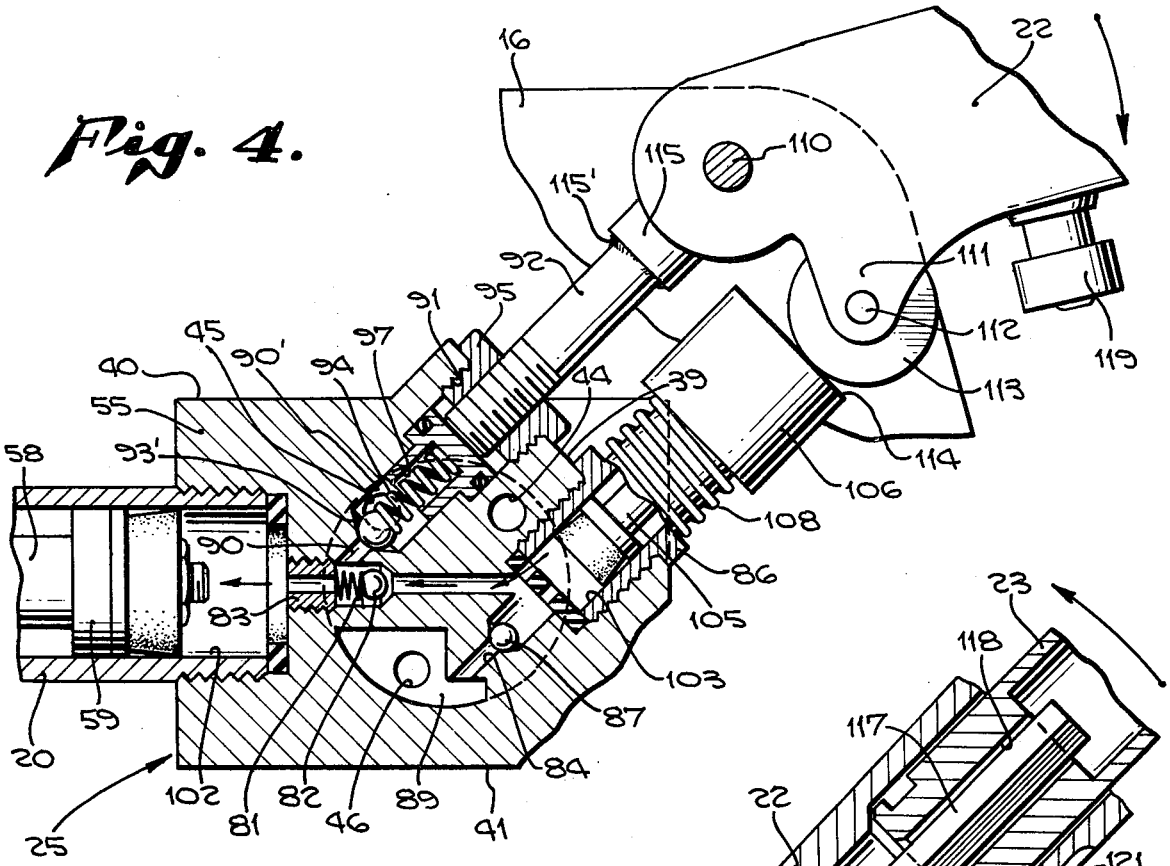
FIGS. 3 and 4 are fragmentary vertical sectional views showing the parts in position for an elevating operation.
Figure 3:
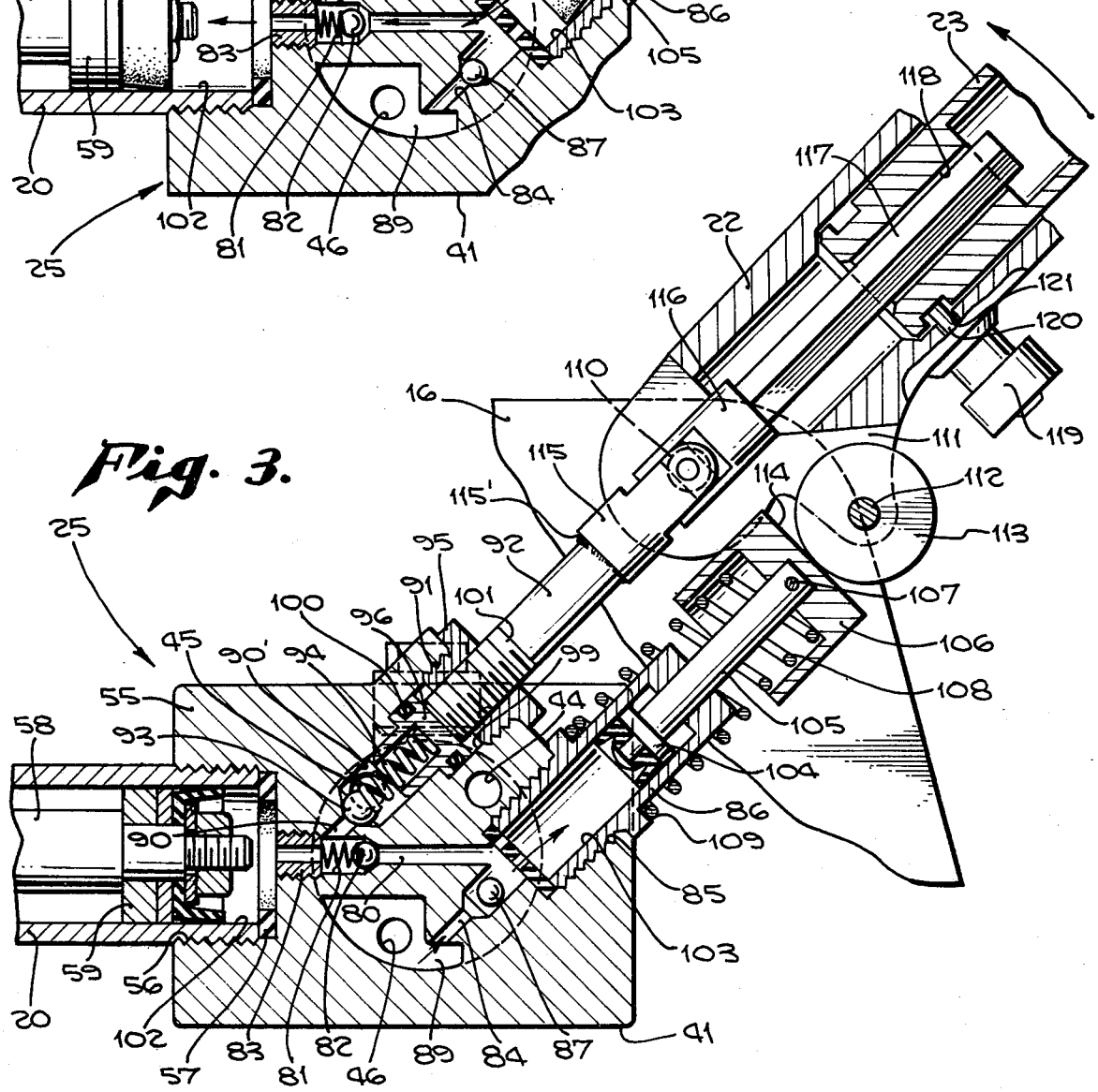

The hydraulic network interconnecting the reservoir chambers 42 and 43 with the hydraulic cylinder is shown in some detail in FIGS. 3, 4 and 5. The network features a first bore 80 which is in axial alignment with the hydraulic cylinder 20 and which can be made by drilling into the block 25 through the boss 55. A suitable enlargement 81 provides for a conventional spring actuated ball check 82 and a threaded adjusting plug 83.

A second bore 84 may also be formed by drilling into the block 25 in axial alignment with a threaded opening 85 in which a pump cylinder 86 is mounted. A ball check 87 is provided for the second bore 84, as shown in FIGS. 3, 4 and 5, and the first bore 80 which is in communication with the second bore 84.

When the second bore 84 is to be supplied with hydraulic fluid from the chambers 42 and 43, the passage 46 serves as a supply passage communicating with a pocket 89 into which the second bore 84 extends.

A third bore 90 may be formed by drilling into the block 25 in axial alignment with a threaded opening 91 which is adapted to threadedly mount a stem 92, in a bushing 95.

A load limit subassembly in communication with the third bore 90 is subject to partial control by the stem 92 when serving as a hydraulic fluid return, during lowering of the elevating linkage.

When, in the alternative, serving as a pressure release to limit the load on the jack, a ball check 93 is seated by action of a spring 94 on a seat 93'. A plunger 96 has a pocket 97 containing part of the length of the spring 94, the bottom of which serves as a spring keeper. An enlarged head of the plunger slides axially in a smooth walled recess 99, wherein action is sealed by an "O" ring 100. The third bore 90 communicates with an enlarged portion 90' on the opposite side of the valve seat 93', and the enlarged portion 90' is in direct communication with the reservoir chambers 42, 43 through the passage 45. A shoulder 99' separates the smooth wall recess 99 from the enlarged portion 90'.

The bore 90 serves a double function, namely that of an overload release passage, and that of a return passage for fluid when the elevating linkage is being lowered.

Figure 6:
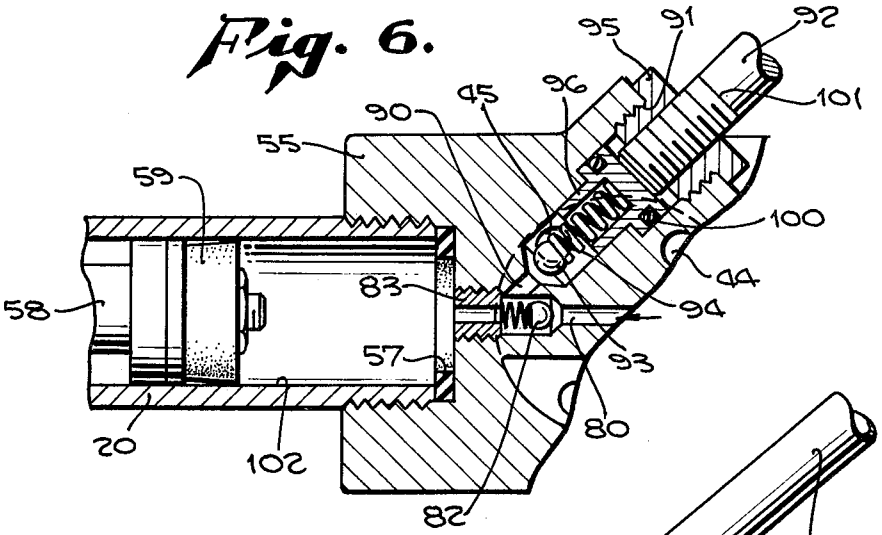
FIG. 6 is a fragmentary longitudinal sectional view similar to FIGS. 3, 4 and 5, showing the position of parts when the overload release is operating.

The fixed tension of the spring 94 is set to determine the maximum pressure which can be pumped into the hydraulic system. When such pressure is exceeded, the check valve 93 yields, as shown in FIG. 6, and fluid is bypassed back to the reservoir chambers 42, 43 through the bore 90, the enlarged portion 90' and the passage 45.

To expressly eliminate action of the spring 94 on the ball check 93, the stem 90 is rotated in a direction so that threads 101 act with internal threads of the bushing 95 to back off the end of the stem 92 from engagement against the plunger. Pressure in a chamber 102 of the hydraulic cylinder 20 can then readily unseat the ball check 93, shifting the plunger 96 if necessary, to permit fluid from the chamber 102 to return to the chambers 42, 43. This is the action which takes place when the elevating linkage is lowering, as shown in FIG. 5.

For details of the pump mechanism, reference is made to FIGS. 3 and 4. The pump cylinder 86, previously mentioned, provides a pump chamber 103 in which is a piston 104 at the end of a piston rod 105. A drive sleeve 106 is pivotally attached by means of a pin 107 to the piston 104. The sleeve surrounds a spring 108 which bears outwardly against the interior of the sleeve and inwardly against a shoulder 109 on the pump cylinder 86, thereby to normally bias the piston 104 and the drive sleeve 106 outwardly.

For reciprocating the piston, the yoke 22 previously described is pivotally mounted upon the side plates 16 and 17 by means of a pivot shaft 110. Arms 111 of the yoke support a pivot shaft 112 at a location offset with respect to the pivot shaft 110 and on the pivot shaft 112 is a roller 113. As the yoke 22 is tilted back and forth by manipulation of the extendible shaft 23, the roller 113, rolling over an end surface 114 of the drive sleeve 106, pumps the drive sleeve and the attached piston 104 in and out in a substantially conventional fashion. This action draws hydraulic fluid from the chambers 42 and 43 through the passage 46 and bore 84 past the ball check 87 during the upstroke and during the downstroke forces the hydraulic fluid through the passage 87, past the ball check 82 into the interior of the hydraulic cylinder 20. The action moves the piston head 59 and attached ram 58 outwardly or in a direction from right to left as viewed in FIGS. 3, 4, 5 and 6.

During the pumping cycle, the ball check 93 is seated upon the valve seat 95, thus closing the bore 90. Seating the valve in this fashion is accomplished by rotation of the extendible shaft 23, customarily in a clockwise or right-hand direction. To accomplish this, in any position of tilt of the extendible shaft 23 and the yoke 22, there is provided a universal joint consisting of one part 115 at the outside end of the stem 92 and another part 116 attached to a hexagonal shaft 117. The hexagonal shaft 117 is received in a hexagonal opening 118 at the lower end of the extendible shaft 23. The stem is anchored to the part 115 by, for example, a weldment 115'.

The extendible shaft 23 is releasably attached to the yoke 22 by employment of a substantially conventional snap lock 119, a lock pin 120 of which engages a recess 121 of the extendible shaft 23. The universal joint part 116 and hence the hexagonal shaft 117 rotates within the yoke 22. On the shaft is an extension 121 terminating in a hand hold 122 whereby this shaft can be lengthened in order to push the jack further under the chassis of an automobile. Another snap lock 123 can be manipulated into a hole such as the hole 124 to hold the extension in a selected adjustment nonrotatably attached to the shaft 123 so that the valve element 92 can be opened or closed at any position of the shaft.

Normally, the shaft is tilted more or less at the angle suggested in FIG. 1. The shaft may also be tilted downwardly to a position almost horizontal.

When the device is to be operated, the operating handle is rotated in a direction to relieve the ball check 93 from the seat 93'. In this condition, the return spring 61 pulls the elevator to its lowermost position as the ram 58 and piston head 59 are moved to substantially the position of FIGS. 3 and 4. The ball check is then seated by rotating the extendible shaft 23 in the opposite direction and the handle is then pumped up and down to operate the pump. During the upstroke pictured in FIGS. 3 and 4, hydraulic fluid from the reservoir is drawn through the second bore 84 into the pump chamber 103. During this position of the stroke the ball check 82 is seated.

Next during the downstroke in the direction of the arrow in FIG. 4, the ball check 87 is seated and hydraulic fluid from the pump chamber 103 is forced through the first bore 80, unseating the ball check 82, and is then forced into a chamber 102 of the hydraulic cylinder 20. As hydraulic fluid continues to be pumped into the chamber 102 by repeated movement of the extendible shaft, the elevating linkage is raised to the desired level. The linkage will stay at that level irrespective of whether or not the extendible shaft is left in a downward tilted position because of seating of the ball check 82. When the linkage is to be lowered, the extendible shaft is merely rotated in a direction unseating the valve element 93 and then hydraulic fluid from the chamber 102 will pass through the third bore 90 past the valve seat 94 and then return to the reservoir through the discharge passage 45. The elevator can be lowered either rapidly or slowly by controlling the degree of opening of the valve element 93.

Figure 8:
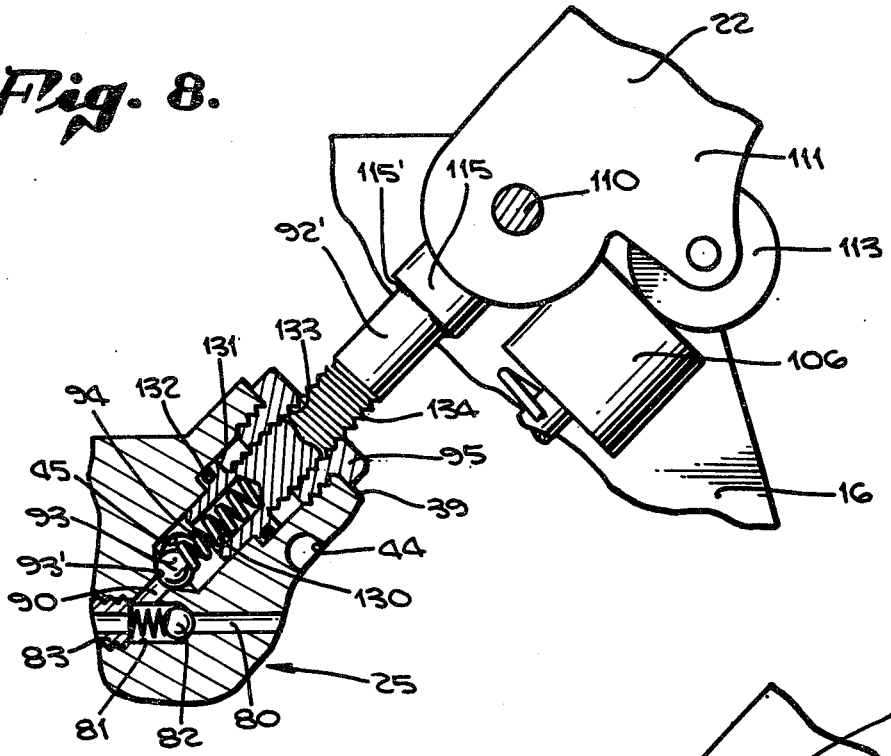
FIG. 8 is a fragmentary longitudinal sectional view of a modified form of the invention similar to the view of FIGS. 2 and 3.

In a somewhat more simple stem structure, as shown in FIG. 8, there is provided a stem member 92' machined as a single piece. In order to have the single piece stem member provide the necessary structure, a pocket 130 is drilled inwardly from one end to accommodate the spring 94 and serve as a spring retainer and spring keeper. Flanges 131 are machined on the exterior in spaced relationship to contain an "O" ring 132 as a sliding seal. The bushing 95 has internal threads 133 to threadedly receive external threads 134 on the stem member 92'.

In this form of the invention the load limit for the check valve 93 is fixed at the factory by the location of critical parts of the stem member 92'. The adjustment of the load limit cannot be changed except by replacement of the stem member with another of different specifications anchored, as indicated, by the weldment 115'.

Figure 9:
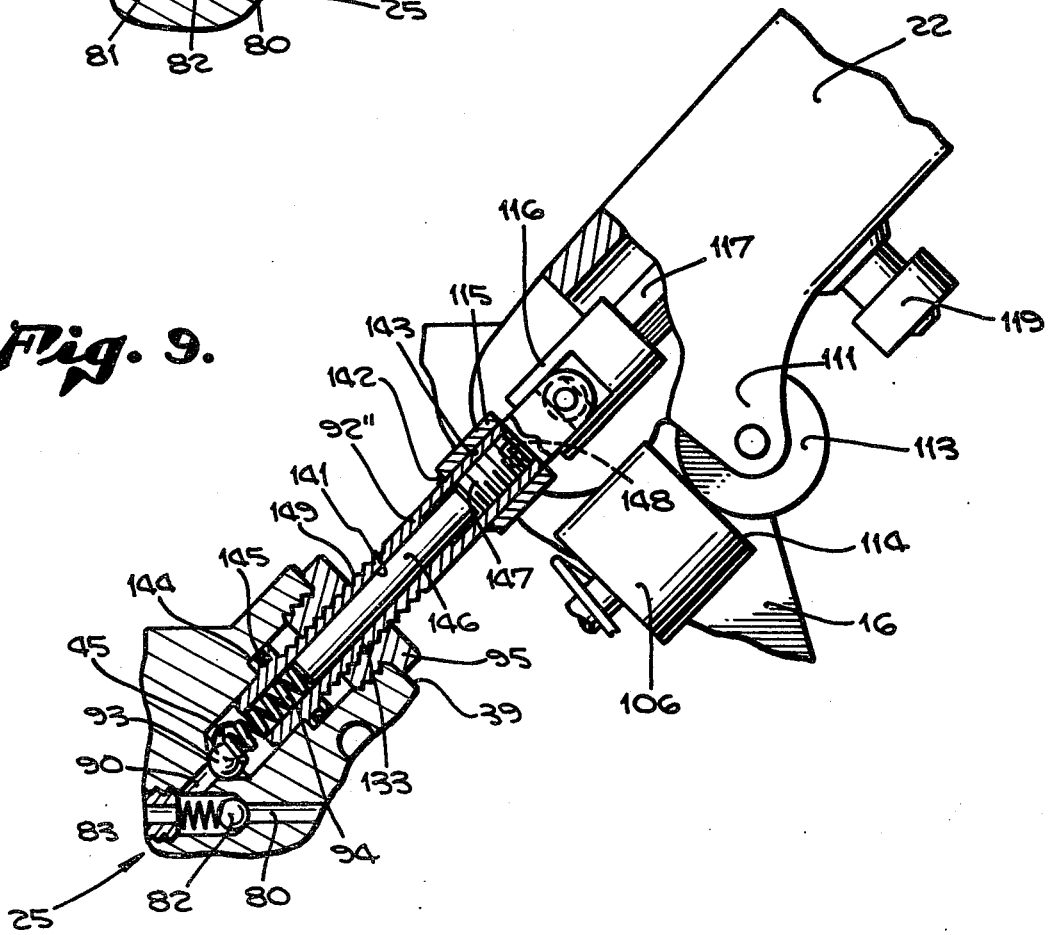
FIG. 9 is a fragmentary longitudinal sectional view of still another form of the invention.

A device wherein the load limit can be adjusted to meet specific conditions is shown in the embodiment of FIG. 9. In this form a stem member 92'' is a composite member consisting of a cylindrical element 140 in the form of a tube having a bore 141 extending therethrough. The cylindrical element is anchored to the part 115 by a weldment 142 and projects into a hole 143 which extends part way through the part 115. Flanges 144 may be formed on the lower exterior of the cylindrical element 140 by appropriate conventional means to accommodate a sliding "O" ring seal 145.

A pin 146 has a threaded fit with a threaded portion 147 of the bore 141, and a sliding fit in the remaining portion of the bore 141. A wrench socket 148 is adapted to accommodate a typical hexagonal wrench (not shown). The lower end of the pin 146 serves as a spring keeper for the spring 94 which bears on the ball check 93. The spring 94 has a guided retention in the lower end of the bore 141.

Following the same structure as in the other forms of the invention, the bushing 95 has internal threads 133 which threadedly engage external threads 149 on the cylindrical element 140 for releasing the ball check 93 when the jack is to be lowered, as heretofore described.

In the last described form of the invention, the load limit is factory adjusted by properly positioning the stem 146 relative to the spring 94. This adjustment can only be changed by breaking the weldment 142 and extracting the cylindrical element from the hole 143, thereby to expose the wrench socket for a new adjustment, by changing tension in the spring 94.

If preferred, the hole 143 could be drilled clear through the part 115 and the wrench socket 148 exposed by separating the parts 115 and 116 for readjusting purposes.

As has been previously noted, virtually all of the bores of the hydraulic network can be drilled from the exterior of a block which can preferably be a forging. All bores and adjacent enlargements are amply recessed. Furthermore, by drilling the bores in axial alignment with the other appurtenances such as the hydraulic cylinder 20, the pump cylinder 86 and the stem 92, a compact accurate arrangement of integrally mounted parts is assured. Providing the relatively heavy partition 47 centerably within the block improves the ruggedness and simplicity of construction. The drilling of the hydraulic network results in a conveniently located set of interconnecting bores which in no way diminishes the ruggedness of the block itself.

Additionally, located as shown, the hydraulic power cylinder lying between the trunnion arms 65 which are near the respective side plates permits employment of a rugged hydraulic power cylinder relatively large in diameter snuggly accommodated within the structure making it possible to provide adequate lift within a small structure. Additionally combining the manufacturing operation such as the drilling and by having parts serve a double function the total number of parts can be substantially minimized and accordingly the weight of the finished apparatus kept within reasonable bounds commensurate with the lift required.

Furthermore, by having the overload release concealed in the hydraulic housing or block 25 and located beneath the extendible shaft 23 and its stem 92, the yoke 22 must be entirely removed, and the yoke with its attached parts must be entirely disassembled to gain access to the ball check 93, its spring 94 and plunger 96 before any change can be made in the overload pressure at which the lifting jack is set.

Having described the invention, what is claimed as new in support of Letters Patent is as follows:

1. In a lifting jack comprising a frame, an elevating linkage pivotally mounted on the frame, a hydraulic housing on the frame having a hydraulic reservoir therein, and a hydraulic power cylinder operatively connected between said frame and said elevating linkage, the combination of a hydraulic network interconnecting said reservoir and said power cylinder and actuating means for said network, said network comprising a first bore in communication with said power cylinder and checked against return flow from said power cylinder, a second bore in communication with said reservoir and checked against flow to said reservoir, and a third bore in communication between said power cylinder and said reservoir, said third bore having an exposed outer end and a combined reverse action and load limit subassembly in said third bore, said actuating means comprising a pump and a pump actuator pivotally mounted on said frame, said pump actuator including reverse control for said elevating linkage, said pump having a pump chamber in communication jointly with said first and second bores, whereby to draw fluid from said reservoir and force fluid into said power cylinder, said load limit subassembly comprising a check valve seat and a load limit check valve element in said third bore seating in a direction to stop flow to said power cylinder, a bushing in fixed position closing the outer end of said third bore, a resilient actuator for said check valve element located between the load limit check valve element and said bushing, said reverse control comprising a stem member extending through said bushing into engagement with said resilient actuator, said stem member having an adjustment of position relative to said resilient actuator whereby to relieve tension in said resilient actuator to establish flow from said power cylinder to said reservoir and enable lowering of said elevating linkage.

2. In a lifting jack as in claim 1 wherein said resilient actuator for the check valve element is a spring and there is a spring keeper for said spring in the form of a plunger having a sealed sliding mounting in said third bore and in operative engagement with said stem member.

3. In a lifting jack as in claim 1 wherein thre is a plunger in said third bore, a shoulder in said third bore and a head on said plunger adapted to engage said shoulder at one limit of movement of said plunger, whereby to set the position of said plunger and the tension potential of said resilient actuator in a predetermined condition productive of an overload release of hydraulic pressure at a fixed amount of pressure.

4. In a lifting jack as in claim 1 wherein there is an enlargement of said third bore with said check valve seat being located at the junction of said third bore and said enlargement.

5. In a lifting jack as in claim 4 wherein said bushing is at the outer end of said enlargement and said bushing has a threaded engagement with said enlargement, the interior of said bushing having a threaded engagement with said stem.

6. In a lifting jack as in claim 5 wherein the threaded engagement of said stem member and said bushing is progressively variable whereby to vary the rate of lowering of said elevating linkage.

7. In a lifting jack as in claim 1 wherein there is an adjustable threaded engagement between said stem member and said hydraulic housing, said stem member being subject to rotation by said pump actuator whereby to change the position of adjustment relative to said resilient actuator.

8. In a lifting jack as in claim 1 wherein said stem member comprising a cylindrical element having a sealed sliding fit in said third bore and a pin element concentrically disposed in said cylindrical element and movable longitudinally therein, said pin being in engagement with said spring and forming a keeper therefore, said pin having a movement to different positions of adjustment in said cylindrical element and relative to said spring, whereby to vary the load limit action of said spring.

9. In a lifting jack as in claim 7, said cylinder element having a jointed mounting on said pump actuator and said pin having a wrench hold located within said jointed mounting.

10. In a lifting jack as in claim 8, said cylinder element having an adjustable threaded engagement adjacent one end with said hydraulic housing and a jointed mounting adjacent the other end on said pump actuator.

11. In a lifting jack as in claim 10, a bushing in threaded engagement respectively with said hydraulic housing and said cylinder element whereby to provide the adjustable threaded engagement of said stem member with said hydraulic housing.

12. In a lifting jack as in claim 1, said stem member having a jointed mounting at one end on said pump actuator and an adjustable threaded engagement with said hydraulic housing the other end of said stem member having an end opening pocket receptive of said resilient actuator.

* * * * *